US005110189A

United States Patent [19]

Haines

[11] Patent Number: 5,110,189

[45] Date of Patent: May 5, 1992

[54] REDUNDANT REMOTE CONTROL SYSTEM USED ON A CONTINUOUS MINER AND METHOD OF USING SAME

[75] Inventor: Marvin L. Haines, Bridgeport, W. Va.

[73] Assignee: Tamrock World Corporation, Netherlands Antilles

[21] Appl. No.: 614,703

[22] Filed: Nov. 16, 1990

[51] Int. Cl.[5] ..... E21C 35/24

[52] U.S. Cl. ..... 299/30; 340/825.01; 340/825.72; 359/145

[58] Field of Search ..... 299/1, 30; 455/59, 603; 340/825.72, 825.69, 825.01

[56] References Cited

U.S. PATENT DOCUMENTS

| | | | |
|---|---|---|---|
| 4,159,470 | 6/1979 | Strojny et al. | 340/825.01 X |
| 4,656,645 | 4/1987 | Kanecko | 340/825.01 X |
| 4,904,993 | 2/1990 | Sato | 340/825.72 X |

FOREIGN PATENT DOCUMENTS

| | | | |
|---|---|---|---|
| 1603837 | 12/1981 | United Kingdom | 299/30 |

OTHER PUBLICATIONS

GLI Corporation Brochure, "Radio Remote Control For Field Retrofit of Standard Continuous Miners", Oct. 1982.

*Primary Examiner*—David J. Bagnell
*Attorney, Agent, or Firm*—Stanley J. Price, Jr.

[57] ABSTRACT

A redundant remote control system for use on a continuous miner having a radio remote control system for the remote control of a continuous miner. The radio remote control system having switches, a multiplexer, a radio transmitter, a radio receiver, a demultiplexer, and a radio interface. The redundant remote control system includes a second system for controlling the same continuous miner, and includes a second transmitter, a second multiplexer, a second receiver, and a second demultiplexer. The second system may be a radio, a fiber optic or electrical cable remote control system.

10 Claims, 3 Drawing Sheets

REDUNDANT REMOTE CONTROL SYSTEM USED ON A CONTINUOUS MINER AND METHOD OF USING SAME

BACKGROUND OF THE INVENTION

1. Field of the Invention

This invention relates to a totally redundant remote control system used on a continuous miner, and more particularly, to a redundant remote control system which includes a dual set of remote control systems each having a transmitter, a multiplexer, a receiver, and a demultiplexer. One of the systems is a standard radio system for the remote control of a continuous miner. The backup system, which duplicates the first system, may be radio or fiber optic controlled.

2. Description of the Prior Art

Remote control systems for underground mining machines are well known in industries utilizing such mining machines. These remote control systems utilize electrical cable, or radio waves to allow an operator to control the mining machine from a distance. Typically, these remote control systems are used in conjunction with guidance systems such as lasers, sonic waves, cameras with reference points, television monitors, or seismic waves.

U.S. Pat. No. 3,332,465 discloses a flexible line suspended from a continuous mining machine at a fixed point to activate circuits in response to a deviation in the direction of the flexible line to direct the continuous mining machine on a course indicated by the flexible line.

U.S. Pat. No. 3,498,673 discloses a guidance system for a tunnel boring machine utilizing a laser fired from a fixed point, onto a reflector mounted on the boring machine which reflects the beam to a target mounted rearward of the reflector on the same boring machine. The machine adjusts its hydraulic pistons connected to gripping shoes, which engage the wall of the borehole, to reorient the boring machine in response to deviations in its position as indicated by the laser.

U.S. Pat. No. 3,517,966 discloses a guiding device for a mine boring machine utilizing an optical system to project an image of a sighting device onto the cutting front of the mining machine. The guiding device permits visual observation of the image by means of a tachymeter at the entrance to the borehole.

U.S. Pat. No. 3,776,592 discloses a directional system utilizing a guidelight shining through a slit in the middle of a plate with two colored portions on either side of the slit. If the machine bears to the right or left, the direction of the machine may be visually corrected by the operator. The machine is remote controlled from a control console through an umbilical cord arrangement attached to switches which activate solenoids, valves, and motors.

U.S. Pat. No. 4,238,828 discloses a position detecting apparatus utilizing a camera with a telephoto lense trained on a reference target and a wide angle lens trained on a target on the boom assembly of a mining machine. The camera conveys this information to a computer which calculates the position of the mining machine head. The computer may also be programmed to control the direction of the machine in a predetermined direction.

U.S. Pat. No. 4,323,280 discloses a mining machine remotely controlled through electrical cables connecting the mining machine to a remote control station. The mining machine has mounted on it television cameras and lights, as well as a laser and a sonar guidance system, which are connected to the control system by a cable.

U.S. Pat. No. 4,523,651 discloses a detector for receiving and relaying seismic signals to a remote control operating station. The detector is mounted on a cart in a borehole and receives the seismic signal generated in the hole being bored by a seismic source in the adjacent hole being bored. The seismic signal is read to determine the direction of the hole being bored relative to the direction of the adjacent borehole and applied to maintain the hole being bored parallel with the borehole containing the detector. The cart that the detector is mounted on is either radio or cable controlled.

U.S Pat. No. 4,774,470 discloses an electromagnetic wave transmitter/receiver mounted on a shield tunnelling machine connected to a computer to assess the condition of the tunnel area adjacent to the cutting head to detect caveins.

U.S. Pat. No. 4,870,697 discloses a two way communication system for transmitting signals to and receiving operating data from a mining machine utilized in underground mining operations. The invention utilizes radio transmitters and receivers.

Although numerous systems propose remote control of mining machines, when the remote control operating system is in operable, the down time is both inconvenient and expensive.

Conventional backup systems in case of radio failure of radio remote control systems utilize an umbilical cord having a three conductor cable connected between the transmitter in the operator's station and to the receiver unit on the mining machine. The signal is transmitted via the cable and bypasses the radio portion of the mining machine radio remote control system. However, the multiplexer and demultiplexer in the radio remote control system must still be functional in order for the backup system to work.

The present invention introduces a redundant remote control system capable of utilizing an umbilical electric cable remote control system, a radio remote control system or a fiber optic remote control system to decrease down time and increase productivity.

It is an object of the present invention to provide a backup system for the remote control of a continuous mining machine that is functional even if the multiplexer and/or demultiplexer of the primary radio remote control system is not functional.

It is a further object of the present invention to provide the operator of the remote control system for a continuous mining machine with the option of using either the primary remote control or backup remote control system.

SUMMARY OF THE INVENTION

In accordance with the present invention, there is provided a continuous mining machine for use in an underground mine which includes a mobile frame assembly, a material dislodging means extending from the mobile frame assembly, a conveying means having a conveying reach and a conveying return reach, a means of propulsion, and a remote control system.

The remote control system is a redundant remote control system for use on a continuous miner. A dual control system includes a radio system for the remote control of the continuous miner having switches, a radio transmitter, a multiplexer, a radio receiver, a demultiplexer, and a radio interface.

A second system for controlling the same continuous miner has a transmitter, a multiplexer, a receiver, and a demultiplexer. The second system for the remote control of the continuous miner may be controlled by either radio, fiber optic, or electrical cable.

In one embodiment of the invention, the first remote control system is a radio remote control system for controlling the continuous miner having switches, a radio transmitter, a multiplexer, a radio receiver, a demultiplexer, and a radio interface. The second system for controlling the continuous mining machine is a fiber optic system, having a fiber optic transmitter, a multiplexer, a fiber optic cable, a fiber optic receiver, and a demultiplexer.

In another embodiment of the invention the redundant remote control control system for use on a continuous miner consists of a first remote control system having switches, a radio transmitter, a multiplexer, a radio receiver, a demultiplexer, and a radio interface. The second system in this embodiment is another radio, having a second radio transmitter, a second multiplexer, a second radio receiver, and a second demultiplexer.

Accordingly, the principal object of the present invention is to provide a totally redundant remote control system for a continuous miner which includes two sets of transmitters, multiplexers, receivers, and demultiplexers for the remote control of continuous mining machines by radio, fiber optics or electrical cables.

DESCRIPTION OF THE PREFERRED EMBODIMENTS

Figure 1:
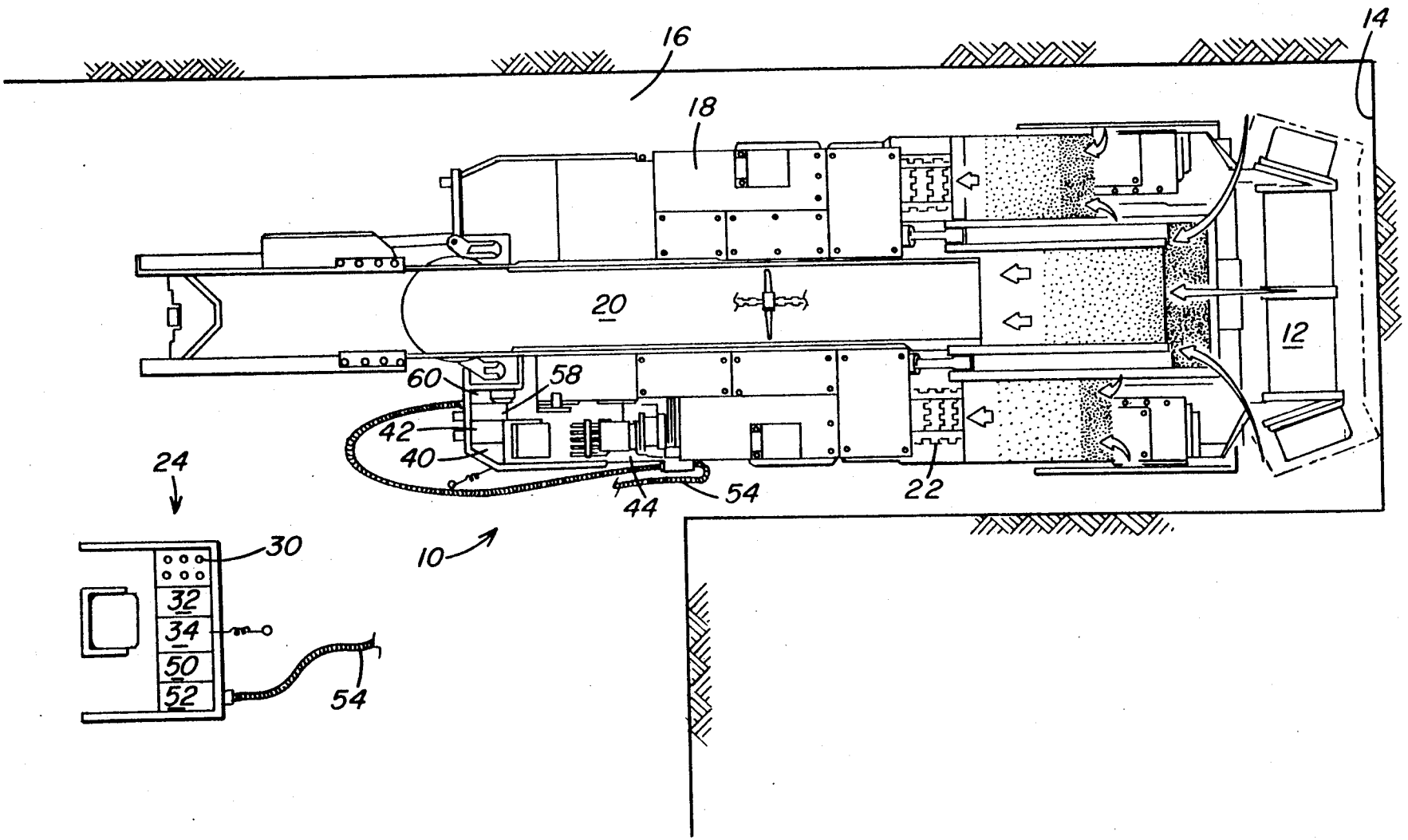
FIG. 1 is a top plan view of a continuous miner with a remotely positioned operator station for the preferred embodiment of the remote control system of the present invention.

Referring to the drawings, and particularly to FIG. 1, there is illustrated a continuous miner generally designated by the numeral 10 for use in underground mining operations. Continuous miner 10 has a material dislodging means 12 to dislodge material from the mine face 14 in the mine entry 16. Continuous miner 10 also has a frame 18, a conveying means 20 and a propulsion means 22.

Figure 2:
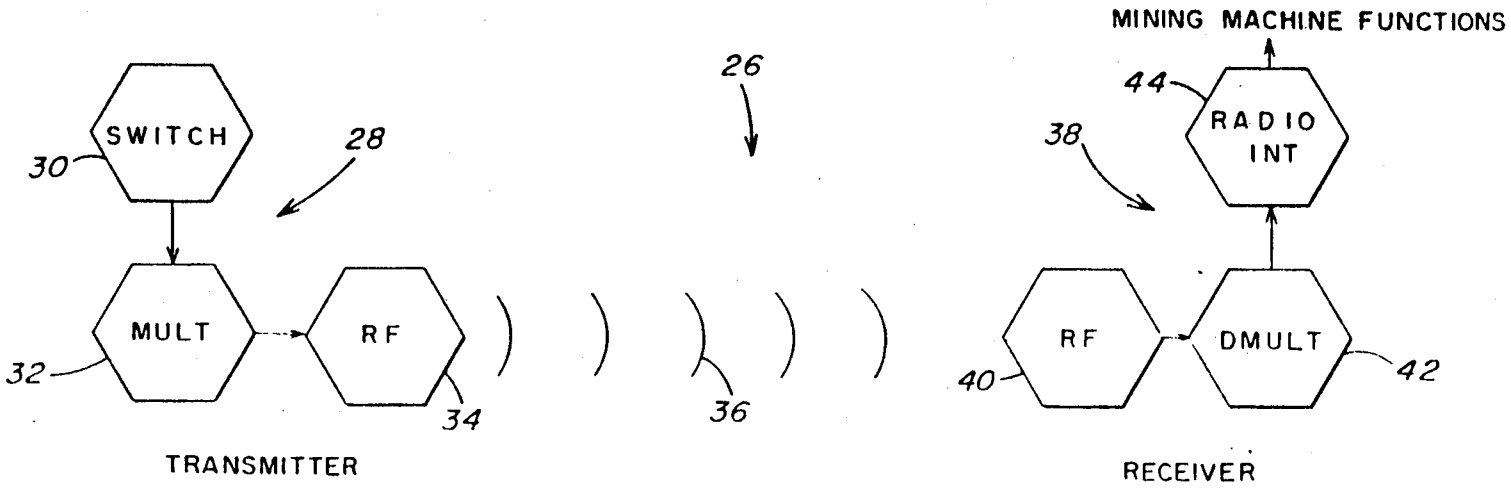
FIG. 2 is a schematic diagram of the primary radio remote control system of the present invention.

Continuous miner 10 is a radio remote controlled from a remotely positioned operator's station 24. As shown in FIG. 2, operator station 24 contains a radio transmitter unit 28 having a switch 30, a multiplexer 32, and a radio transmitter 34. When the switch 30 is activated by the operator it sends a signal to the multiplexer 32. The multiplexer 32 combines many control signals into one, and transmits the signal to the radio transmitter 34. The radio transmitter 34 sends the signal out in the form of radio waves 36. The radio waves 36 are received by the radio receiver 40 on the continuous miner 10. The radio receiver unit 38 on continuous miner 10 also includes a demultiplexer 42 which receives the signal from the radio receiver 40, demultiplexes the signal, and passes this signal on to the radio interface 44. The radio interface 44 translates the signal into miner functions. The receiver unit 38 on the continuous miner 10 includes the radio receiver 40, the demultiplexer 42, and the radio interface 44. Transmitter unit 28 and receiver unit 38 comprise the primary radio remote control system 26.

Figure 3:
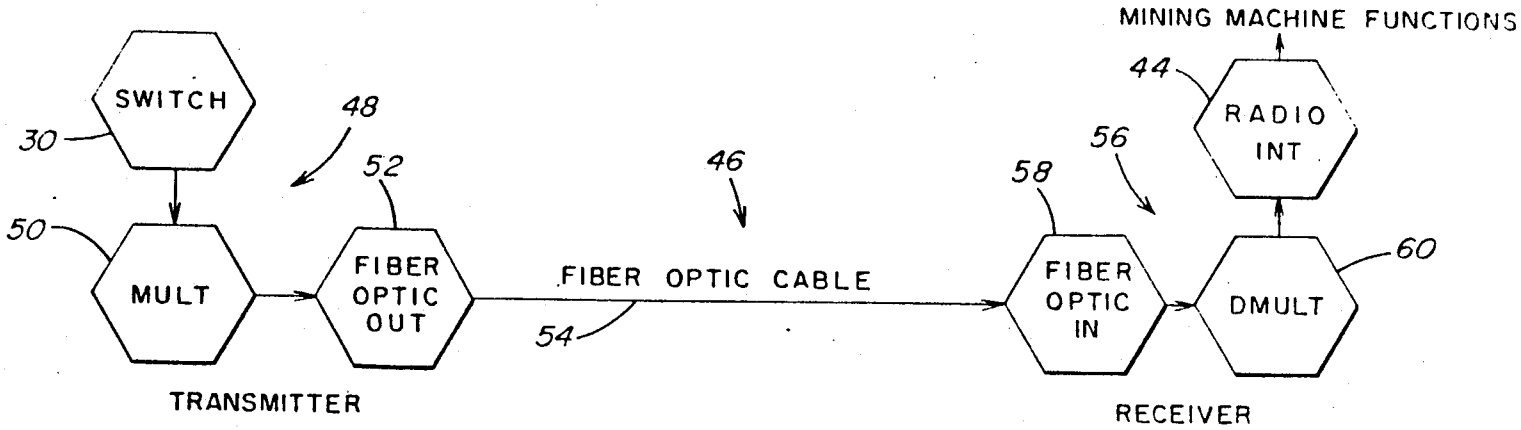
FIG. 3 is a schematic diagram of the fiber optic backup system of the present invention.

The preferred embodiment also includes a fiber optic system 46, as shown schematically in FIG. 3, as a backup system for the primary radio remote control system 26. The fiber optic system 46 has a transmitter unit 48 which includes switches 30, a multiplexer 50, and a fiber optic transmitter 52. The switches 30 send signals to the multiplexer 50, which combines multiple signals from the switches 30 into one control signal This multiplexed control signal is transmitted through the fiber optic cable 54, by the fiber optic transmitter 52.

The fiber optic system 46 also includes a receiver unit 56 on the continuous miner 10 as shown in FIG. 1. The receiver unit 56 includes a fiber optic receiver 58 to receive the light impulses sent through the fiber optic cable 54 by the fiber optic transmitter 52. The fiber optic receiver 58 relays the signal to the demultiplexer 60 which decodes the multiplexed signal. The demultiplexer 60 sends the demultiplexed signal to the radio interface 44. The radio interface 44 activates the miner functions.

The fiber optic control system 46 operates as a parallel independent system to that of the radio system 26. The fiber optic cable 54 requires no electrical isolation as it transmits light energy, not an electrical impulse. The continuous miner machine 10 may be controlled from the operator station 24 by either the radio remote control system 26 or the fiber optic remote control system 46, as the operator chooses.

The fiber optic multiplexer 50, the fiber optic demultiplexer 60, the fiber optic transmitter 52, the fiber optic receiver 58, and the fiber optic cable 54 are commercially available from OEM controls in Shelton, Conn. The radio multiplexer 32, the radio transmitter 34, the radio receiver 40, the radio demultiplexer 42, and the radio interface 44 are available commercially from Moog, Inc., Electronics and Systems Division, East Aurora, N.Y.

The radio system 26 may be used in any one of four frequency channels; channel 1 is 467.750 MHZ, channel 2 is frequency 467.800 MHZ, channel 3 is frequency 467.850 MHZ, and channel 4 is frequency 467.900 MHZ. Channel selection is by means of a selector switch accessible from the outside of the transmitter 34 and the receiver 40.

The power supply for the radio transmitter unit 28 of the radio system 26 is a standard miners cap lamp battery. The power supply for the radio receiver unit 38 of the radio system 26 is an intrinsically safe output unit with the following specifications; voltage is 12 volts D.C. and the output current is 3 amps maximum. The output power is between 0.66 to 22.64 watts. The operating range of the radio system 26 is 150 feet, but may be significantly reduced around corners. The transmission link comprises digital and encoding of the selected function with the phase shift modulation of the FM carrier frequency.

The security system for the radio remote control system 26 includes the necessity for the sending unit code to be verified for each 96 bits of data per scan cycle. The timing, address, and the data bit sequence must align with the plug in code card in the receiver. Several successive (3 to 4) "On" commands must be successfully processed to turn a function "On". A period of 8 to 9 seconds of unverified data must lapse before the automatic frequency scanning resumes. Proportional control data is rate limited to require more than 0.5 seconds for a 100 percentage change. "Valid transmission Output" will return to "0" within one half of one second if the succeeding command data is not received.

Fiber optic system 46 utilizes a digitization system. All data, analogue and digital, is digitized before transmission. This eliminates analogue noise. The digitization is into binary data words. The fiber optic remote control system 46 detects and rejects erroneous "noise" data. The data words in the fiber optic remote control system 46 include stop, start, and parity bits. The bits are checked upon coding. Errors call immediate reset.

The fiber optic remote control system 46 requires proper synchronization before activation of continuous miner 10 functions. The correct number of data words must be present. Extra bits in the data words within a frame or parity errors cause loss of activation for the function entered.

The power supply for the receiver unit 56 of the fiber optic remote control system 46 on continuous miner 10 is a 12/24 volt DC power supply from the vehicle system.

In another embodiment of the present invention, there is provided continuous mining machine 10 as shown in FIG. 1. Continuous miner 10 has a dislodging means 12 for dislodging material from mine face 14 within a mine 16. Continuous miner machine 10 has a frame 18, a conveyor 20, a means for propulsion 22. Continuous miner 10 may be controlled from a remote control station 24. Remote control station 24 has a radio transmitter unit 28, as shown in FIG. 2, which consists of a switch 30, a multiplexer 32 and a radio transmitter 34. The operator moves the switches 30 which send signals to the multiplexer 32. The multiplexer 32 combines multiple signals into one control signal which is then sent to the radio transmitter 34. The radio transmitter 34 sends the signal in the form of a radio wave 36 which is received by the receiver unit 38 on the continuous miner 10.

The radio receiver unit 38 receives the radio waves 36 from the radio transmitter 34 in the radio receiver 40 and sends them on to the demultiplexer 42. The demultiplexer 42 decodes the signal received from the radio receiver 40 and relays the demultiplexed signal to the radio interface 44 which activates continuous miner 10 functions.

Figure 4:
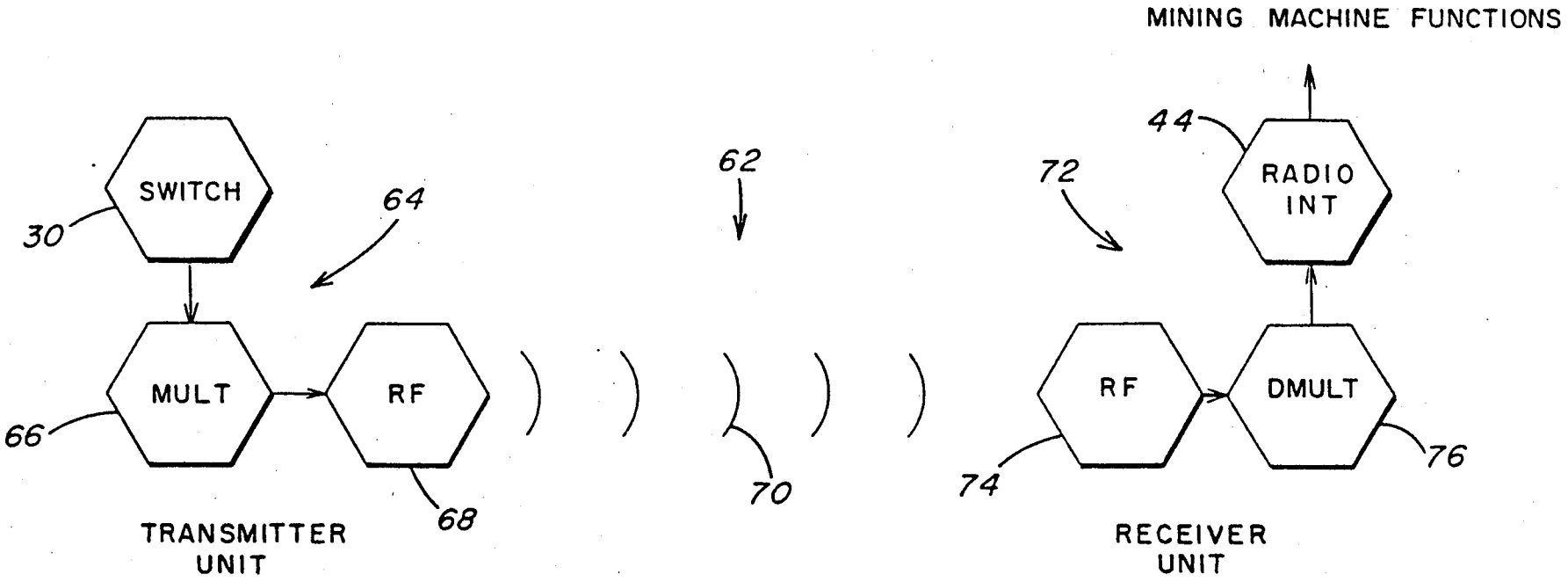
FIG. 4 is a schematic diagram of the backup radio remote control system.

In this embodiment of the present invention, there is a redundant radio system 62 as shown in FIG. 4, including a another radio transmitter unit 64 having switches 30, another multiplexer 66, and another radio transmitter 68. The operator at the remote control station 24 activates the switches 30 which send signals to the multiplexer 66. The multiplexer 66 combines the multiple signals received from the switches 30 into a single control signal which is sent to the radio transmitter 68. The radio transmitter 68 sends the multiplexed signal via radio waves 70 which are received by the radio receiver unit 72 on the continuous miner 10. The receiver unit 72 includes a radio receiver 74, a demultiplexer 76 and a radio interface 44.

The radio waves 70 are received by the radio receiver 74. The radio receiver 74 transmits the signal to the demultiplexer 76 which demultiplexes the signal and sends it to the radio interface 44, which translates the demultiplexed signal into continuous miner 10 functions.

According to the provisions of the Patent Statutes, we have explained the principle, preferred construction and mode of operation of our invention and have illustrated and described what we now consider to represent its best embodiments. However, it should be understood that, within the scope of the appended claims, the invention may be practiced otherwise then as specifically illustrated and described.

I claim:

1. A method of remote control for use on a continuous miner comprising the steps of, providing for the remote control of a continuous miner a first system having at least one switch, a first multiplexer, a first transmitter, a first receiver, a first demultiplexer and a first continuous miner interface, positioning said switch, said first multiplexer, and said first transmitter in an operator station located remote from said continuous miner, connecting said first receiver and said first demultiplexer to said first continuous miner interface on said continuous mining machine, translating a signal from said first demultiplexer by said continuous miner interface into miner functions, providing for the remote control of said continuous mining machine a second system having a second multiplexer, a second transmitter, a second receiver and a second demultiplexer, arranging said second multiplexer and said second transmitter in said operator station, connecting said second receiver and said second demultiplexer to said continuous miner, and interconnecting said second demultiplexer with said continuous miner interface to receive a signal from said second system to initiate miner functions in the event of failure of said first system.

2. The method of remote control for use on a continuous miner as in claim 1 wherein, providing a radio remote control system as said first system.

3. The method of remote control for use on a continuous miner as in claim 2 wherein, providing another radio remote control system as said second system.

4. The method of remote control for use on a continuous miner as in claim 2 wherein, providing an electrical cable remote control system as said second system.

5. A method of remote control for use on a continuous miner comprising the steps of, providing for the remote control of a continuous miner a first system having at least one switch, a first multiplexer, a first transmitter, a first receiver, a first demultiplexer and a first continuous miner interface, positioning said switch, said first multiplexer, and said first transmitter in an operator station located remote from said continuous miner, connecting said first receiver and said first demultiplexer to said first continuous miner interface on said continuous mining machine, providing for the remote control of said continuous mining machine a second system having a second multiplexer, a second transmitter, a second receiver and a second demultiplexer, arranging said second multiplexer and said second transmitter in said operator station, connecting said second receiver and said second demultiplexer to said continuous miner, providing as said second system, a fiber optic remote control system including a fiber optic cable remotely connecting said second transmitter with said second receiver, and transmitting light impulses from said second transmitter through said fiber optic cable to said second receiver.

6. A continuous minor comprising, a mobile frame assembly having a front end portion and a rear end portion, a material dislodging means attached to said front end portion of said mobile frame assembly, a conveying means attached to said mobile frame assembly for receiving material from said dislodging means and to convey said material rearwardly of said continuous miner, a propulsion means attached to said mobile frame assembly for propelling said continuous miner, a remote control means for activating functions on said continuous miner at a distance from said continuous miner, said remote control means having a first system and a second system for the remote control of said continuous miner, said first system having at least one switch, a first multiplexer, and a first transmitter in an operator station, said first system having a first receiver, a first demultiplexer and a first interface on said continuous miner, a second system having a second multiplexer and a second transmitter being in said operator station, said second system having a second receiver and a second demultiplexer on said continuous miner, and said second demultiplexer interconnected with said first interface on said continuous miner to receive a signal from said second system to initiate operation of said continuous miner in the event of failure of said first system.

7. The continuous miner as in claim 6 wherein, said first system is a radio remote control system.

8. The continuous miner as in claim 6 wherein, said second system being a fiber optic remote control system.

9. The continuous miner as in claim 6 wherein, said second system being another remote control system.

10. The continuous miner as in claim 6 wherein, said second system being an electrical cable remote control system.

* * * * *